US007046256B2

(12) United States Patent
Credelle

(10) Patent No.: US 7,046,256 B2
(45) Date of Patent: May 16, 2006

(54) SYSTEM AND METHODS OF SUBPIXEL RENDERING IMPLEMENTED ON DISPLAY PANELS

(75) Inventor: Thomas Lloyd Credelle, Morgan Hill, CA (US)

(73) Assignee: Clairvoyante, Inc, Sebastopol, CA (US)

( * ) Notice: Subject to any disclaimer, the term of this patent is extended or adjusted under 35 U.S.C. 154(b) by 0 days.

(21) Appl. No.: 10/349,768

(22) Filed: Jan. 22, 2003

(65) Prior Publication Data

US 2004/0140983 A1 Jul. 22, 2004

(51) Int. Cl.
*G09G 5/00* (2006.01)

(52) U.S. Cl. ..... 345/613; 345/690; 345/214; 345/204; 345/87

(58) Field of Classification Search ..... 345/204–206, 345/694, 696, 690, 214, 613–614, 84–90
See application file for complete search history.

(56) References Cited

U.S. PATENT DOCUMENTS

| | | | |
|---|---|---|---|
| 3,971,065 A | | 7/1976 | Bayer |
| 4,353,062 A | | 10/1982 | Lorteije et al. |
| 4,593,978 A | | 6/1986 | Mourey et al. |
| 4,642,619 A | | 2/1987 | Togashi |
| 4,651,148 A | | 3/1987 | Takeda et al. |
| 4,751,535 A | | 6/1988 | Myers |
| 4,773,737 A | | 9/1988 | Yokono et al. |
| 4,786,964 A | | 11/1988 | Plummer et al. |
| 4,792,728 A | | 12/1988 | Chang et al. |
| 4,800,375 A | | 1/1989 | Silverstein et al. |
| 4,853,592 A | | 8/1989 | Strathman |
| 4,874,986 A | | 10/1989 | Menn et al. |
| 4,886,343 A | | 12/1989 | Johnson |
| 4,908,609 A | | 3/1990 | Stroomer |
| 4,920,409 A | | 4/1990 | Yamagishi |
| 4,946,259 A | | 8/1990 | Matino et al. |
| 4,965,565 A | | 10/1990 | Noguchi |
| 4,966,441 A | | 10/1990 | Conner |
| 4,967,264 A | | 10/1990 | Parulski et al. |
| 5,006,840 A | | 4/1991 | Hamada et al. |
| 5,052,785 A | | 10/1991 | Takimoto et al. |
| 5,113,274 A | * | 5/1992 | Takahashi et al. ..... 349/109 |
| 5,132,674 A | | 7/1992 | Bottorf |
| 5,144,288 A | | 9/1992 | Hamada et al. |
| 5,184,114 A | | 2/1993 | Brown |
| 5,189,404 A | | 2/1993 | Masimo et al. |
| 5,196,924 A | | 3/1993 | Lumelsky et al. |
| 5,233,385 A | | 8/1993 | Sampsell |
| 5,311,205 A | | 5/1994 | Hamada et al. |

(Continued)

FOREIGN PATENT DOCUMENTS

DE 299 09 537 U1 10/1999

(Continued)

OTHER PUBLICATIONS

Brown Elliott, C, "Co-Optimization of Color AMLCD Subpixel Architecture and Rendering Algorithms," SID 2002 Proceedings Paper, May 30, 2002.

(Continued)

*Primary Examiner*—Matthew C. Bella
*Assistant Examiner*—Wesner Sajous

(57) ABSTRACT

Various embodiments of a display system are disclosed. One embodiment comprises a panel having a set of drivers connected to a subpixel rendering circuit in which the number of data lines going to the drivers is less than the different number of color data sets generated by the subpixel rendering circuit. In another embodiment, the driver circuits and/or the subpixel rendering circuit are constructed on the panel, using the panel's thin film transistors.

6 Claims, 11 Drawing Sheets

U.S. PATENT DOCUMENTS

| | | | | |
|---|---|---|---|---|
| 5,311,337 | A | 5/1994 | McCartney, Jr. | |
| 5,315,418 | A | 5/1994 | Sprague et al. | |
| 5,334,996 | A | 8/1994 | Tanigaki et al. | |
| 5,341,153 | A | 8/1994 | Benzschawel et al. | |
| 5,398,066 | A | 3/1995 | Martinez-Uriegas et al. | |
| 5,436,747 | A | 7/1995 | Suzuki | |
| 5,459,595 | A | 10/1995 | Ishiguro et al. | |
| 5,461,503 | A | 10/1995 | Deffontaines et al. | |
| 5,477,240 | A | 12/1995 | Huebner et al. | |
| 5,485,293 | A | 1/1996 | Robinder | |
| 5,535,028 | A | 7/1996 | Bae et al. | |
| 5,541,653 | A | 7/1996 | Peters et al. | |
| 5,543,819 | A * | 8/1996 | Farwell et al. | 345/694 |
| 5,561,460 | A | 10/1996 | Katoh et al. | |
| 5,563,621 | A | 10/1996 | Silsby | |
| 5,579,027 | A | 11/1996 | Sakurai et al. | |
| 5,642,176 | A | 6/1997 | Abukawa et al. | |
| 5,646,702 | A | 7/1997 | Akinwande et al. | |
| 5,648,793 | A | 7/1997 | Chen | |
| 5,661,371 | A | 8/1997 | Salerno et al. | |
| 5,724,112 | A | 3/1998 | Yoshida et al. | |
| 5,739,802 | A | 4/1998 | Mosier | |
| 5,754,226 | A | 5/1998 | Yamada et al. | |
| 5,792,579 | A | 8/1998 | Phillips | |
| 5,815,101 | A | 9/1998 | Fonte | |
| 5,821,913 | A | 10/1998 | Mamiya | |
| 5,899,550 | A | 5/1999 | Masaki | |
| 5,903,366 | A | 5/1999 | Hirabayashi et al. | |
| 5,917,556 | A | 6/1999 | Katayama | |
| 5,929,843 | A | 7/1999 | Tanioka | |
| 5,933,253 | A | 8/1999 | Ito et al. | |
| 5,949,496 | A | 9/1999 | Kim | |
| 5,973,664 | A | 10/1999 | Badger | |
| 6,002,446 | A | 12/1999 | Eglit | |
| 6,008,868 | A | 12/1999 | Silverbrook | |
| 6,034,666 | A | 3/2000 | Kanai et al. | |
| 6,037,719 | A | 3/2000 | Yap et al. | |
| 6,038,031 | A | 3/2000 | Murphy | |
| 6,049,626 | A | 4/2000 | Kim | |
| 6,061,533 | A | 5/2000 | Kajiwara | |
| 6,064,363 | A | 5/2000 | Kwon | |
| 6,097,367 | A | 8/2000 | Kuriwaki et al. | |
| 6,108,122 | A | 8/2000 | Ulrich et al. | |
| 6,144,352 | A | 11/2000 | Matsuda et al. | |
| 6,160,535 | A | 12/2000 | Park | |
| 6,184,903 | B1 | 2/2001 | Omori | |
| 6,188,385 | B1 * | 2/2001 | Hill et al. | 345/614 |
| 6,198,507 | B1 | 3/2001 | Ishigami | |
| 6,219,025 | B1 * | 4/2001 | Hill et al. | 345/589 |
| 6,225,967 | B1 | 5/2001 | Hebiguchi | |
| 6,225,973 | B1 | 5/2001 | Hill et al. | |
| 6,236,390 | B1 | 5/2001 | Hitchcock | |
| 6,239,783 | B1 | 5/2001 | Hill et al. | |
| 6,243,055 | B1 | 6/2001 | Fergason | |
| 6,243,070 | B1 | 6/2001 | Hill et al. | |
| 6,271,891 | B1 | 8/2001 | Ogawa et al. | |
| 6,278,434 | B1 | 8/2001 | Hill et al. | |
| 6,299,329 | B1 | 10/2001 | Mui et al. | |
| 6,326,981 | B1 | 12/2001 | Mori et al. | |
| 6,327,008 | B1 | 12/2001 | Fujiyoshi | |
| 6,332,030 | B1 | 12/2001 | Manjunath | |
| 6,346,972 | B1 | 2/2002 | Kim | |
| 6,348,929 | B1 | 2/2002 | Acharya | |
| 6,360,008 | B1 | 3/2002 | Suzuki et al. | |
| 6,360,023 | B1 | 3/2002 | Betrisey et al. | |
| 6,377,262 | B1 | 4/2002 | Hitchcock et al. | |
| 6,392,717 | B1 | 5/2002 | Kunzman | |
| 6,393,145 | B1 | 5/2002 | Betrisey et al. | |
| 6,396,505 | B1 | 5/2002 | Lui | |
| 6,414,719 | B1 | 7/2002 | Parikh | |
| 6,441,867 | B1 | 8/2002 | Daly | |
| 6,453,067 | B1 | 9/2002 | Morgan et al. | |
| 6,466,618 | B1 | 10/2002 | Messing et al. | |
| 6,483,518 | B1 | 11/2002 | Perry et al. | |
| 6,545,653 | B1 | 4/2003 | Takahara | |
| 6,570,584 | B1 | 5/2003 | Cok et al. | |
| 6,590,555 | B1 | 7/2003 | Su et al. | |
| 6,624,828 | B1 | 9/2003 | Dresevic et al. | |
| 6,633,306 | B1 * | 10/2003 | Marz et al. | 345/698 |
| 6,661,429 | B1 | 12/2003 | Phan | |
| 6,674,430 | B1 | 1/2004 | Kaufman | |
| 6,674,436 | B1 | 1/2004 | Dresevic et al. | |
| 6,697,037 | B1 * | 2/2004 | Alt et al. | 345/93 |
| 6,714,206 | B1 | 3/2004 | Martin et al. | |
| 6,738,526 | B1 | 5/2004 | Betrisey et al. | |
| 6,750,875 | B1 | 6/2004 | Keely, Jr. | |
| 6,771,028 | B1 | 8/2004 | Winters | |
| 6,781,626 | B1 | 8/2004 | Wang | |
| 6,801,220 | B1 | 10/2004 | Greier et al. | |
| 6,804,407 | B1 | 10/2004 | Weldy | |
| 6,833,890 | B1 | 12/2004 | Hong et al. | |
| 6,836,300 | B1 | 12/2004 | Choo et al. | |
| 6,850,294 | B1 | 2/2005 | Roh et al. | |
| 6,867,549 | B1 | 3/2005 | Cok et al. | |
| 6,885,380 | B1 | 4/2005 | Primerano et al. | |
| 6,888,604 | B1 | 5/2005 | Rho et al. | |
| 6,897,876 | B1 | 5/2005 | Murdoch et al. | |
| 6,903,378 | B1 | 6/2005 | Cok | |
| 6,917,368 | B1 * | 7/2005 | Credelle et al. | 345/589 |
| 2001/0017515 | A1 | 8/2001 | Kusunoki et al. | |
| 2001/0040645 | A1 | 11/2001 | Yamazaki | |
| 2001/0048764 | A1 | 12/2001 | Betrisey et al. | |
| 2002/0012071 | A1 | 1/2002 | Sun | |
| 2002/0015110 | A1 | 2/2002 | Elliott | |
| 2002/0017645 | A1 | 2/2002 | Yamazaki | |
| 2002/0093476 | A1 | 7/2002 | Hill et al. | |
| 2002/0122160 | A1 | 9/2002 | Kunzman | |
| 2002/0140831 | A1 | 10/2002 | Hayashi | |
| 2002/0149598 | A1 * | 10/2002 | Greier et al. | 345/589 |
| 2002/0190648 | A1 | 12/2002 | Bechtel et al. | |
| 2003/0006978 | A1 * | 1/2003 | Fujiyoshi | 345/204 |
| 2003/0011603 | A1 | 1/2003 | Koyama | |
| 2003/0011613 | A1 | 1/2003 | Booth, Jr. | |
| 2003/0034992 | A1 * | 2/2003 | Brown et al. | 345/690 |
| 2003/0043567 | A1 | 3/2003 | Hoelen et al. | |
| 2003/0071775 | A1 | 4/2003 | Ohashi et al. | |
| 2003/0071826 | A1 | 4/2003 | Goertzen | |
| 2003/0071943 | A1 | 4/2003 | Choo et al. | |
| 2003/0077000 | A1 | 4/2003 | Blinn | |
| 2003/0117422 | A1 * | 6/2003 | Hiyama et al. | 345/690 |
| 2003/0193056 | A1 | 10/2003 | Takayama et al. | |
| 2003/0218618 | A1 | 11/2003 | Phan | |
| 2004/0008208 | A1 | 1/2004 | Dresevic et al. | |
| 2004/0021804 | A1 | 2/2004 | Hong et al. | |
| 2004/0085495 | A1 | 5/2004 | Roh et al. | |
| 2004/0095521 | A1 | 5/2004 | Song et al. | |
| 2004/0108818 | A1 | 6/2004 | Cok et al. | |
| 2004/0114046 | A1 | 6/2004 | Lee et al. | |
| 2004/0155895 | A1 | 8/2004 | Lai | |
| 2004/0169807 | A1 | 9/2004 | Rho et al. | |
| 2004/0179160 | A1 | 9/2004 | Rhee et al. | |
| 2004/0189662 | A1 | 9/2004 | Frisken et al. | |
| 2004/0189664 | A1 | 9/2004 | Frisken et al. | |
| 2004/0213449 | A1 | 10/2004 | Safaee-Rad | |
| 2004/0223005 | A1 | 11/2004 | Lee | |
| 2004/0239813 | A1 | 12/2004 | Klompenouwer | |
| 2004/0239837 | A1 | 12/2004 | Hong et al. | |
| 2004/0247070 | A1 | 12/2004 | Ali | |
| 2004/0263528 | A1 | 12/2004 | Murdoch et al. | |
| 2005/0007539 | A1 | 1/2005 | Taguchi et al. | |
| 2005/0024380 | A1 | 2/2005 | Lin et al. | |
| 2005/0031199 | A1 | 2/2005 | Ben-Chorin et al. | |
| 2005/0040760 | A1 | 2/2005 | Taguchi et al. | |
| 2005/0068477 | A1 | 3/2005 | Shin et al. | |

| | | | |
|---|---|---|---|
| 2005/0083356 | A1 | 4/2005 | Roh et al. |
| 2005/0094871 | A1 | 5/2005 | Berns et al. |
| 2005/0099426 | A1 | 5/2005 | Primerano et al. |
| 2005/0140634 | A1 | 6/2005 | Takatori |
| 2005/0162600 | A1 | 7/2005 | Rho et al. |
| 2005/0169551 | A1 | 8/2005 | Messing et al. |

FOREIGN PATENT DOCUMENTS

| | | | |
|---|---|---|---|
| DE | 199 23 527 | | 11/2000 |
| DE | 201 09 354 | U1 | 9/2001 |
| EP | 0 158 366 | A2 | 10/1985 |
| EP | 0 203 005 | A1 | 11/1986 |
| EP | 0 322 106 | A2 | 6/1989 |
| EP | 0 0671 650 | | 9/1995 |
| EP | 0 793 214 | A1 | 9/1997 |
| EP | 0 812 114 | A1 | 12/1997 |
| EP | 0 878 969 | | 11/1998 |
| EP | 0 899 604 | A2 | 3/1999 |
| EP | 1 083 539 | A2 | 3/2001 |
| EP | 1 261 014 | A2 | 11/2002 |
| GB | 2 133 912 | A | 8/1984 |
| GB | 2 146 478 | A | 4/1985 |
| JP | 60-107022 | | 6/1985 |
| JP | 02-000826 | A | 1/1990 |
| JP | 03-078390 | | 4/1991 |
| JP | 03-36239 | B | 5/1991 |
| JP | 06-102503 | | 4/1994 |
| JP | 02-983027 | B2 | 11/1999 |
| JP | 2001203919 | | 7/2001 |
| JP | 2004004822 | | 1/2004 |
| WO | WO 97/23860 | | 7/1997 |
| WO | WO 00/21067 | | 4/2000 |
| WO | WO 00/42564 | | 7/2000 |
| WO | WO 00/42762 | | 7/2000 |
| WO | WO 00/45365 | | 8/2000 |
| WO | WO 00/65432 | | 11/2000 |
| WO | WO 00/67196 | | 11/2000 |
| WO | WO 01/10112 | A2 | 2/2001 |
| WO | WO 01/29817 | A1 | 4/2001 |
| WO | WO 01/52546 | A2 | 7/2001 |
| WO | WO 02/059685 | A2 | 8/2002 |
| WO | WO 03/014819 | A1 | 2/2003 |
| WO | WO 2004/021323 | A2 | 3/2004 |
| WO | WO 2004/027503 | A1 | 4/2004 |
| WO | WO 2004/040548 | A1 | 5/2004 |
| WO | WO 2004/086128 | A1 | 10/2004 |
| WO | WO 2005/050296 | A1 | 6/2005 |

OTHER PUBLICATIONS

Brown Elliott, C, "Development of the PenTile Matrix™ Color AMLCD Subpixel Architecture and Rendering Algorithms", SID 2003, Journal Article.

Brown Elliott, C, "New Pixel Layout for PenTile Matrix™ Architecture", IDMC 2002.

Brown Elliott, C, "Reducing Pixel Count Without Reducing Image Quality", Information Display Dec. 1999.

Felgenblatt, Ron, "Remarks on Microsoft ClearType™", http://www.geocities.com/SiliconValley/Ridge/6664/ ClearType.html, Dec. 5, 1998, Dec. 7, 1998, Dec. 12, 1999, ec. 26, 1999, Dec.

Adobe Systems, Inc., website, 2002, http://www.adobe.com/products/acrobat/cooltype.html.

Betrisey, C., et al., "Displaced Filtering for Patterned Displays," 2000, *Society for Information Display* (*SID*)*00 Digest*, pp. 296-299.

Carvajal, D., "Big Publishers Looking Into Digital Books," Apr. 3, 2000, *The New York Times*, Business/Financial Desk.

"ClearType magnified,"*Wired Magazine*, Nov. 8, 1999, Microsoft Typography, article posted Nov. 8, 1999, and last updated Jan. 27, 1999, © 1999 Microsoft Corporation, 1 page.

Credelle, Thomas L. et al., "P-00: MTF of High-Resolution PenTile Matrix™ Displays," *Eurodisplay 02 Digest*, 2002, pp. 1-4.

Daly, Scott, "Analysis of Subtriad Addressing Algorithms by Visual System Models," *SID Symp. Digest*, Jun. 2001, pp. 1200-1203.

Elliott, C., "Active Matrix Display Layout Optimization for Sub-pixel Image Rendering," Sep. 2000, Proceedings of the 1st International Display Manufacturing Conference, pp. 185-189.

Elliott, Candice H. Brown et al., "Color Subpixel Rendering Projectors and Flat Panel Displays," New Initiatives in Motion Imaging, SMPTE Advanced Motion Imaging Conference, Feb. 27-Mar. 1, 2003, Seattle, Washington, pp. 1-4.

Elliott, Candice H. Brown et al., "Co-optimization of Color AMLCD Subpixl Architecture and Rendering Algorithms," *SID Symp. Digest*, May 2002, pp. 172-175.

Elliott, C., "New Pixel Layout for PenTile Matrix," Jan. 2002, Proceedings of the International Display Manufacturing Conference, pp. 115-117.

Elliott, C., "Reducing Pixel Count without Reducing Image Quality," Dec. 1999, *Information Display*, vol. 15, pp. 22-25.

Feigenblatt, R.I., "Full-color imaging on amplitude-quantized color mosaic displays," *SPIE*, vol. 1075, Digital Image Processing Application, 1989, pp. 199-204.

Gibson Research Corporation, website, "Sub-Pixel Font Rendering Technology, How it Works," 2002, http://www.grc.com/ctwhat.html.

Johnston, Stuart J., "An Easy Read: Microsoft's Clear Type," *InformationWeek Online, Redmond, WA*, Nov. 23, 1998, 3 pages.

Johnston, Stuart J., "Clarifying ClearType," *InformationWeek Online, Redmond, WA*, Jan. 4, 1999, 4 pages.

"Just Outta Beta," *Wired Magazine*, Dec. 1999, Issue 7.12, 3 pages.

Klompenhouwer, Michiel A. et al., "Subpixel Image Scaling for Color Matrix Displays," *SID Symp. Digest*, May 2002, pp. 176-179.

Krantz, John H. et al., "Color Matrix Display Image Quality: The Effects of Luminance and Spatial Sampling," *SID International Symposium, Digest of Technical Papers*, 1990, pp. 29-32.

Lee, Baek-woon et al., "40.5L: Late-News Paper: TFT-LCD with RGBW Color System," *SID 03 Digest*, 2003, pp. 1212-1215.

Markoff, John, "Microsoft's Cleartype Sets Off Debate on Orginality," *The New York Times*, Dec. 7, 1998, 5 pages.

Martin, R., et al., "Detectability of Reduced Blue Pixel Count in Projection Displays," May 1993, *Society for Information Display* (*SID*)*93 Digest*, pp. 606-609.

Messing, Dean S. et al., "Improved Display Resolution of Subsampled Colour Images Using Subpixel Addressing," *Proc. Int. Conf. Image Processing* (*ICIP '02*), Rochester, N.Y., IEEE Signal Processing Society, 2002, vol. 1, pp. 625-628.

Messing, Dean S. et al., "Subpixel Rendering on Non-Striped Colour Matrix Displays," *International Conference on Image Processing*, Barcelona, Spain, Sep. 2003, 4 pages.

"Microsoft ClearType," http://www.microsoft.com/opentype/cleartype, Mar. 26, 2003, 4 pages.

Microsoft Corporation, website, http://www.microsoft.com/typography/cleartype, 2002, 7 pages.
Microsoft Press Release, Nov. 15, 1998, Microsoft Research Announces Screen Display Breakthrough at COMDEX/Fall '98, PR Newswire.
Murch, M., "Visual Perception Basics," 1987, *SID*, Seminar 2, Tektronix, Inc., Beaverton, Oregon.
Okumura, H., et al., "A New Flicker-Reduction Drive Method for High-Resolution LCTVs," May 1991, *Society for Information Display* (*SID*) *International Symposium Digest of Technical Papers*, pp. 551-554.
Platt, John C., "Optimal Filtering for Patterned Displays," Microsoft Research *IEEE Signal Processing Letters*, 2000, 4 pages.
Platt, John, "Technical Overview of ClearType Filtering," Microsoft Research, http://www.research.microsoft.com/users/jplatt/cleartype/default.aspx, Sep. 17, 2002, 3 pages.
Poor, Alfred, "LCDs: The 800-pound Gorilla," *Information Display*, Sep. 2002, pp. 18-21.
"Ron Feigenblatt's remarks on Microsoft ClearType™," http://www.geocities.com/SiliconValleyRidge/6664/ClearType.html, Dec. 5, 1998, Dec. 7, 1998, Dec. 12, 1999, Dec. 26, 1999, Dec. 30, 1999, and Jun. 19, 2000, 30 pages.
"Sub-Pixel Font Rendering Technology," © 2003 Gibson Research Corporation, Laguna Hills, CA, 2 pages.
Wandell, Brian A., Stanford University, "Fundamentals of Vision: Behavior, Neuroscience and Computation," Jun. 12, 1994, *Society for Information Display* (*SID*) *Short Course S-2*, Fairmont Hotel, San Jose, California.
Werner, Ken, "OLEDs, OLEDs, Everywhere . . . ," *Information Display*, Sep. 2002, pp. 12-15.

* cited by examiner

SYSTEM AND METHODS OF SUBPIXEL RENDERING IMPLEMENTED ON DISPLAY PANELS

BACKGROUND

In commonly owned U.S. patent application Ser. No. 09/916,232 ("the '232 application"), now U.S. Patent Publication No. 2002/0015110, herein incorporated by reference entitled "ARRANGEMENT OF COLOR PIXELS FOR FULL COLOR IMAGING DEVICES WITH SIMPLIFIED ADDRESSING" filed on Jul. 25, 2001 as well as in commonly owned U.S. patent application Ser. No. 10/278,353 ("the '353 application"), now U.S. Patent Publication No. 2003/0128225, herein incorporated by reference entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE"filed on Oct. 22, 2002, and in commonly owned U.S. patent application Ser. No. 10/278,352 ("the '352 application"), now U.S. Patent Publication No. 2003/0128179, herein incorporated by reference entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUBPIXELS" filed on Oct. 22, 2002, novel subpixel arrangements are therein disclosed for improving the cost/performance curves for image display devices.

These subpixel arrangements achieve better cost/performance curves than traditional RGB striping systems—particularly when coupled with subpixel rendering means and methods further disclosed in those applications and in commonly owned U.S. patent application Ser. No. 10/051,612 ("the '612 application"), now U.S. Patent Publication No. 2003/0034992, herein incorporated by reference entitled "CONVERSION OF RGB PIXEL FORMAT DATA TO PENTILE MATRIX SUB-PIXEL DATA FORMAT" filed on Jan. 16, 2002; and in commonly owned U.S. patent application Ser. No. 10/150,355 ("the '355 application"), now U.S. Patent Publication No. 2003/0103058, herein incorporated by reference entitled "METHODS AND SYSTEMS FOR SUB-PIXEL RENDERING WITH GAMMA ADJUSTMENT" filed on May 17, 2002; and in commonly owned U.S. patent application Ser. No. 10/215,843 ("the '843 application"), now U.S. Patent Publication No. 2003/0085906, herein incorporated by reference entitled "METHODS AND SYSTEMS FOR SUB-PIXEL RENDERING WITH ADAPTIVE FILTERING" filed on Aug. 8, 2002.

These novel subpixel arrangements and systems and methods of performing subpixel rendering thereon cuts across nearly every technology base for creating a display. In particular, liquid crystal displays (LCDs) are particularly well suited to these novel arrangements and methods—as the above mentioned technology sharply improves display performance by increasing or holding the same resolution and MTF with a reducing the number of pixel elements when compared with RGB stripe systems. Thus, manufacturing yields for high resolution LCD displays should improve utilizing this novel technology.

It is known in the art of LCD display manufacturing to migrate row and column drivers—traditionally found on an IC driver circuit external to the active matrix display—onto the display itself. In polysilicon (e.g. low temperature poly silicon (LTPS)) active matrix displays, amorphous silicon active matrix displays or generally active matrix displays made with CdSe or other semiconductor materials, additional thin film transistors (TFTs) are created onto the display itself that serve as driving circuitry for the display—thereby lowering the cost of the combined driver/display system. FIG. 1A depicts a current conventional display system 100 that comprises a display panel 102 having row (104) and column (106) drivers comprising TFTs manufactured onto the panel. Separately, an integrated circuit (108*a*)—typically an application specific integrated circuit (ASIC) or field programmable gate array (FPGA)—accepts data input and may provide both timing or clocking of the data and outputing of the data and timing or clock signals to the panel.

As for driver circuitry, it would be advantegeous to leverage the cost savings of utilizing some processing capability of the TFTs on the panel to provide subpixel rendering processing (SPR) directly on the panel.

BRIEF DESCRIPTION OF THE DRAWINGS

The accompanying drawings, which are incorporated in, and constitute a part of this specification illustrate various implementations and embodiments disclosed herein.

DETAILED DESCRIPTION

Reference will now be made in detail to implementations and embodiments of the invention, examples of which are illustrated in the accompanying drawings. Wherever possible, the same reference numbers will be used throughout the drawings to refer to the same or like parts.

Figure 1A:
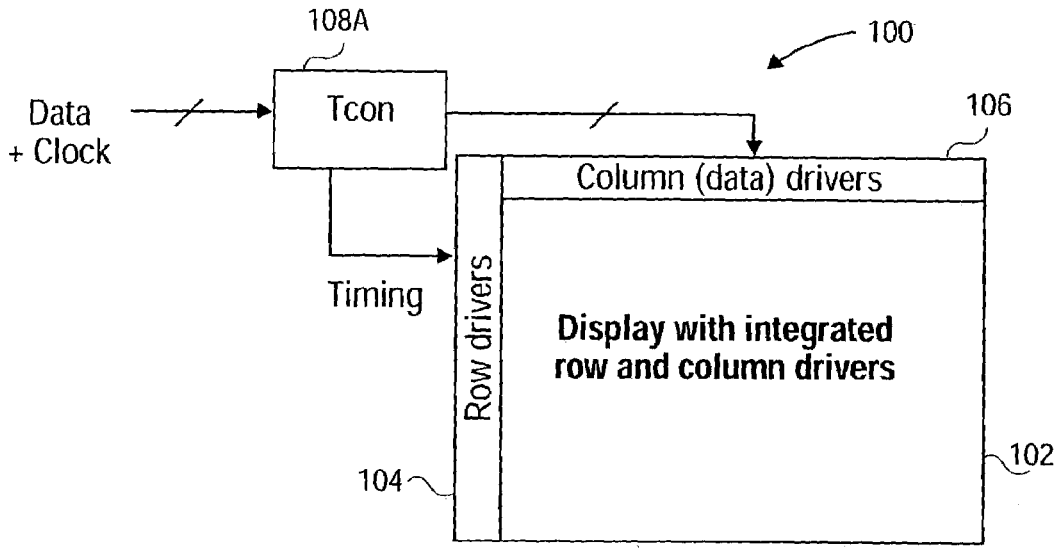
FIG. 1A (PRIOR ART)
FIG. 1A shows a conventional polysilicon or amorphous silicon LCD display system with row and column drivers integrated onto the panel.
Figure 1B:
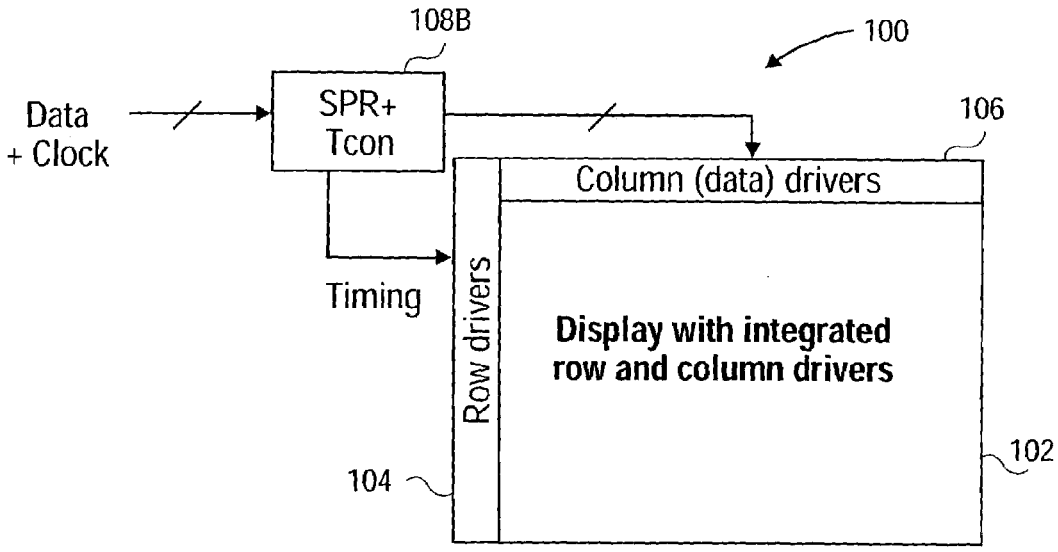
FIG. 1B shows a polysilicon or amorphous silicon LCD display system with row and column drivers integrated onto a panel that includes external subpixel rendering that might be required for new pixel layouts.

FIG. 1B depicts one embodiment of a system that might include SPR on a separate chip (108*b*). Such SPR might be provided to drive panels having new subpixel arrangements as detailed in several applications noted above and herein incorporated by reference.

Figure 2:
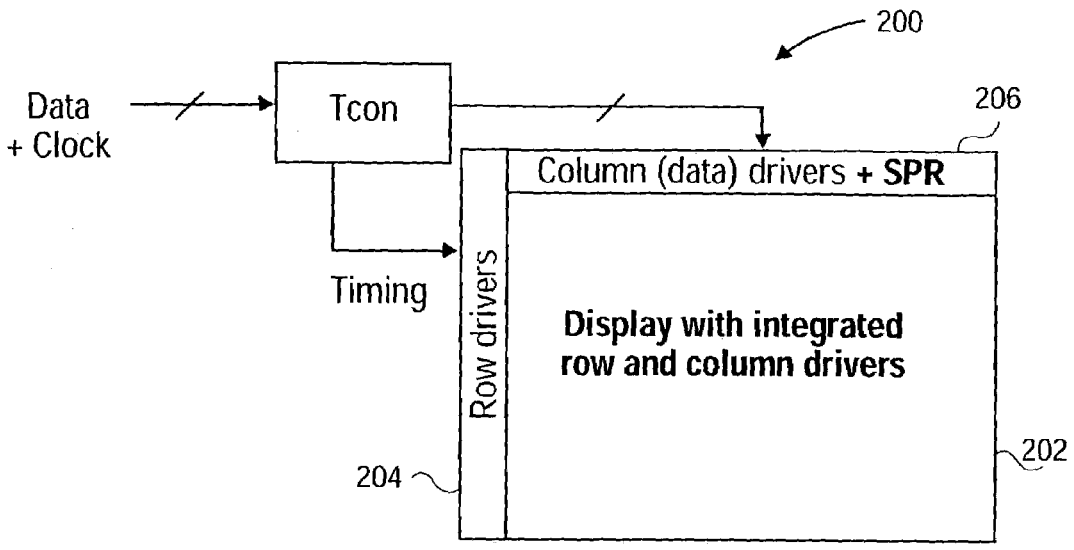
FIG. 2 depicts one embodiment of a high level block diagram of the present invention with subpixel rendering processing circuitry constructed onto the panel.

FIG. 2 is one embodiment of a high level block diagram made in accordance with the principles of the present invention. Display system 200 comprises a display panel 202—which further comprises row drivers 204 and a combined column driver and SPR circuitry 206 integrated into the panel using additional TFTs. The SPR function may include gamma pipeline (the '355 application), remapping filters (the '612 application), adaptive filtering (the '843 application), and clock frequency translator function. Tcon 208 provides timing control for the panel.

Figure 3:
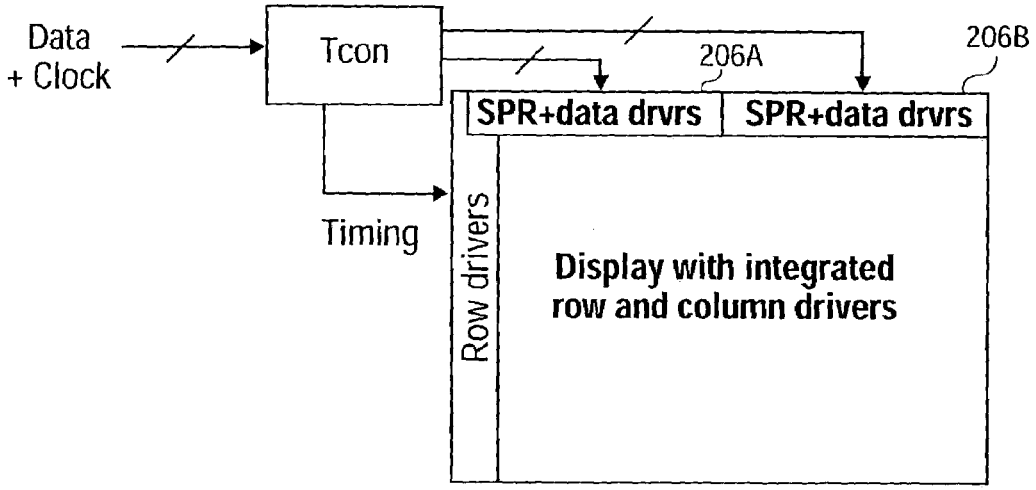
FIG. 3 depicts another embodiment of a high level block diagram of the present invention.

FIG. 3 is another embodiment of a high level block diagram of a suitable system. In this system, the SPR and column drivers are split into multiple units 206A, 206B (etc. for as many other units, as is suitable). The units effectively break the panel into blocks so that the required speed of the incoming data needing to be rendered on the display is matched against the performance of the display.

Figure 4A:
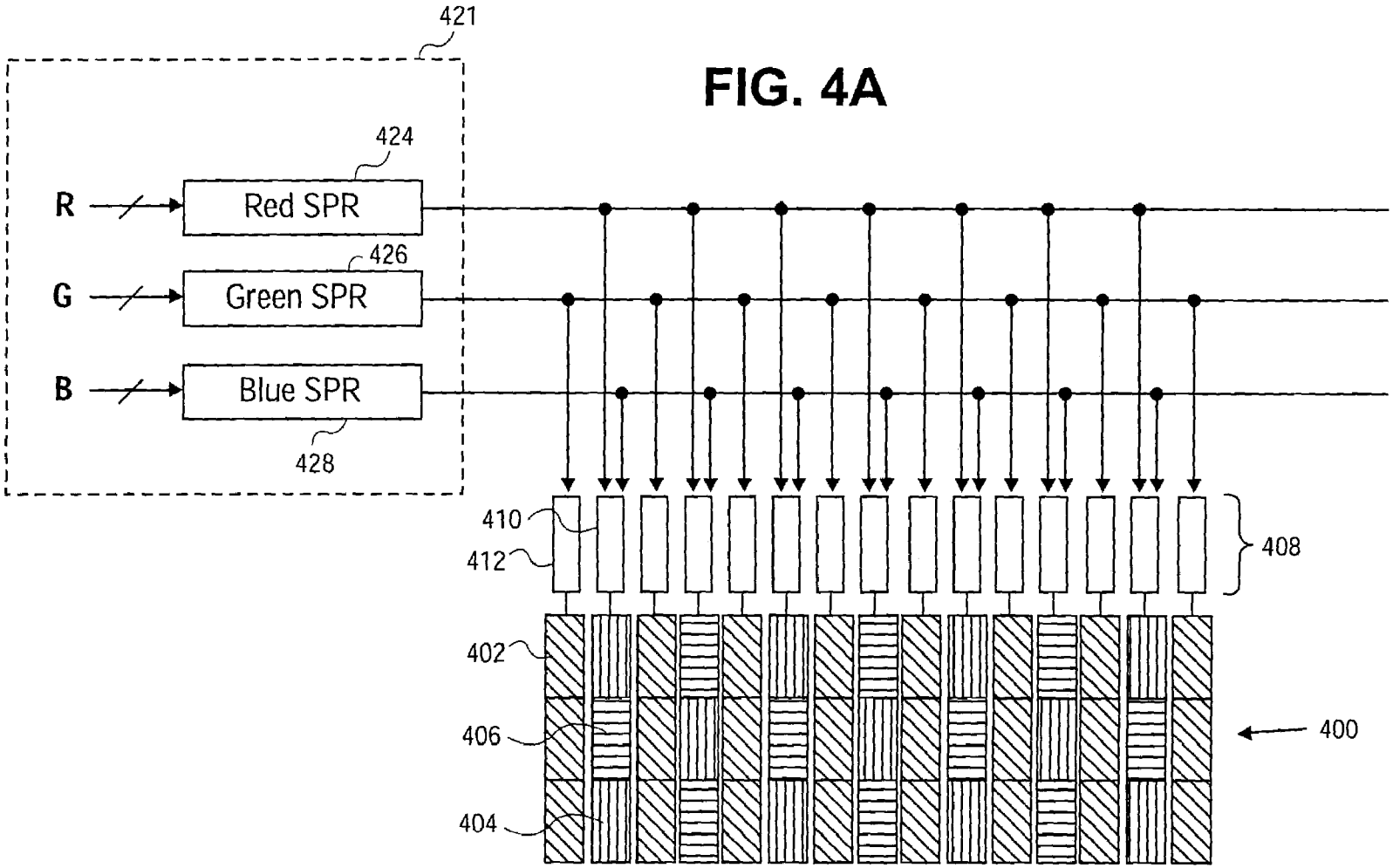
FIG. 4A is one embodiment of the integrated SPR circuitry onto a display panel where the panel comprising a subpixel layout with at least one column having alternating color data.
Figure 4B:
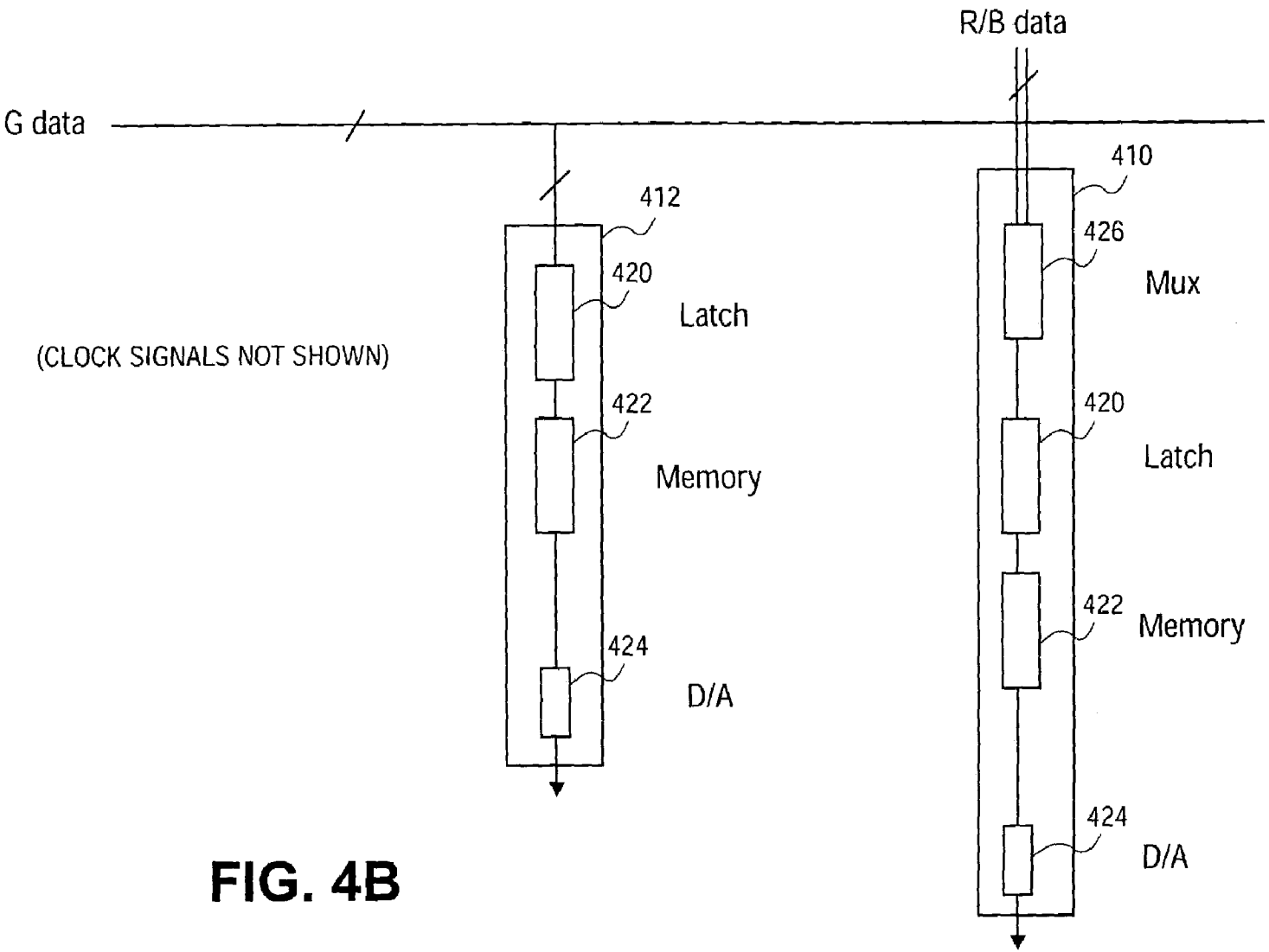
FIG. 4B is an embodiment of a driver circuit suitable to drive data lines where there is alternating color data thereon.

FIG. 4A is one embodiment of the integrated SPR circuitry onto a display panel where the panel comprising a subpixel layout as described in the '353 application. Panel 400 comprises an eight subpixel repeat pattern in which the green subpixels 402 are twice as numerous as, the blue 406 and red subpixels 404. Although shown as the same size in FIG. 4A, the green subpixels 402 can be narrower than the blue 406 and red subpixels 404, as disclosed in the '353 application. Driver circuitry 408 is coupled to the column data lines of the panel. As can be seen, every other column lines of subpixels comprises alternating red and blue subpixels. As such, one embodiment of a driver circuit 410 for such a R/B line is shown in FIG. 4B. Driver 410 accepts two data paths for the red and blue data input. Mux 426 accepts this red/blue data and, depending on which data is being clocked in, sends appropriate red and blue data to latch 420. Data is transferred to memory 422 during the interval between lines of data. D/A converter 424 does the appropriate conversion of data to a format suitable for driving individual pixels in a column. Driver 412 for the green data would not require a MUX.

As is the case in FIG. 4A, if the subpixels of the panel have different widths and/or dimensions, it may be advantegous to construct the driver TFT for the bigger subpixels larger than those driving subpixels of smaller size and dimensioning. The driver TFT is larger because it must supply higher currents to drive the larger capacitance of the larger pixels.

The red, green and blue SPR data is accomplished by SPR circuitry 421. It will be appreciated that SPR circuitry 421 could be constructed either on the panel similar to the driver circuitry 408, or could reside in a chip connected to the panel. SPR circuitry 421 further comprises red (424), green (426), and blue (428) SPR circuitry that would implement the various subpixel rendering methods—in accordance with the various patent applications incorporated herein, or any of the known subpixel rendering routines.

FIG. 4B shows the driver architecture in a typical panel with integrated drivers. Data from SPR blocks are tranferred to indivdual circuit blocks. In the case of green, the data is transferred directly to latch 420. Red and blue data are transferred to MUX 426 at half the clock frequency of green data. MUX 426 selects one of the data paths depending on which row is being addressed by row driver block. After the MUX, the data flow is the same for red, green, and blue data. It passes down to latch 420 then to memory 422 and out from D/A 424.

Figure 5A:
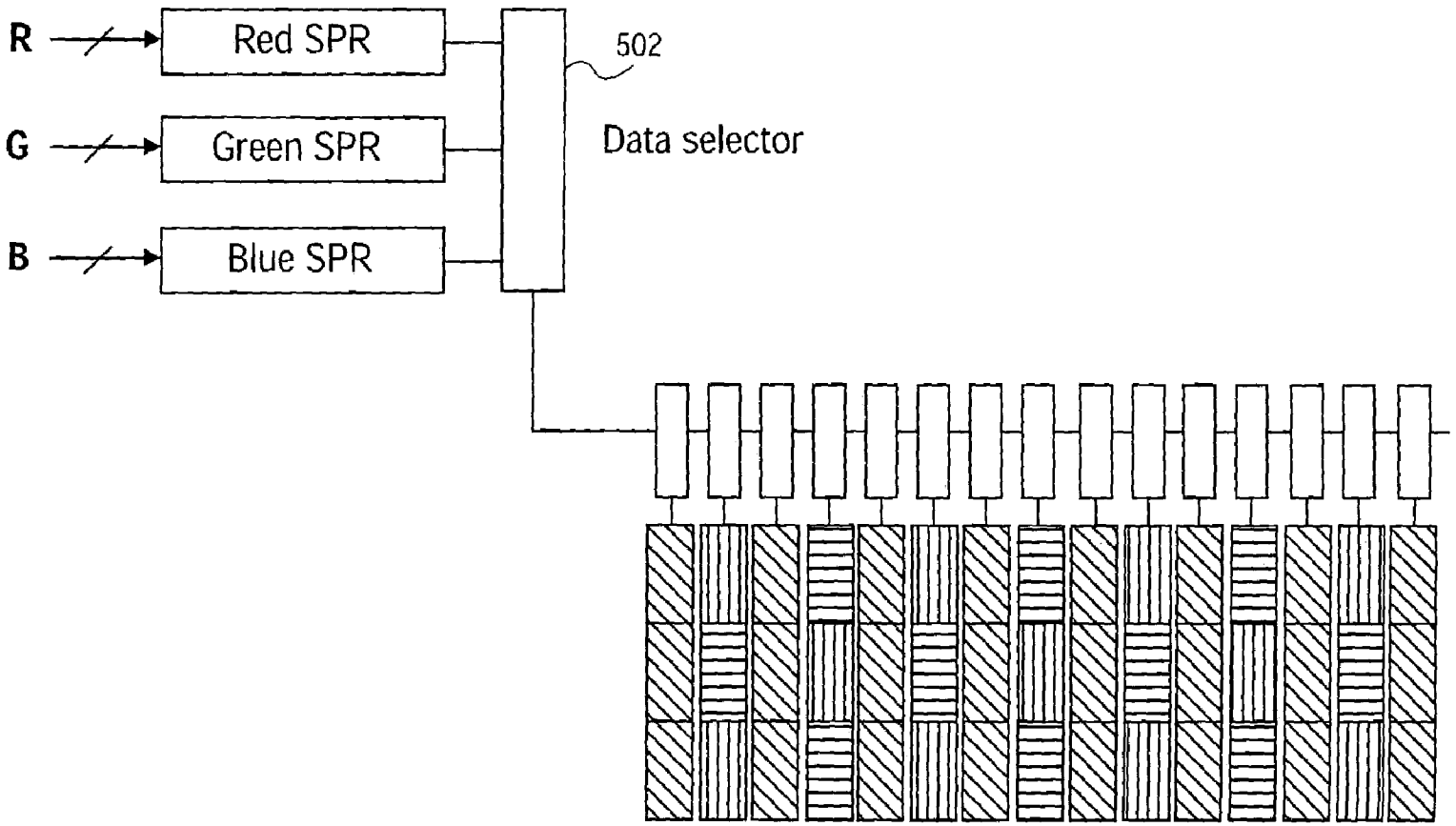
FIG. 5A is another embodiment of the integrated SPR circuitry onto a display panel where the panel comprising a subpixel layout with at least one column having alternating color data.

FIG. 5A is another embodiment of the integrated SPR circuitry onto a display panel. In this embodiment, there is one data path on which all R,G, and B data is transmitting. Data from red, green and blue SPR are being selected by data selector (or MUX) 502 so that for one line being rendered, the data is read out as GRGBGRGB and the next line is read out as GBGRGBGR and repeated. The data frequency could be 1.5 times higher than the incoming frequency, but the number of data paths is cut from three lines to one line.

Figure 5B:
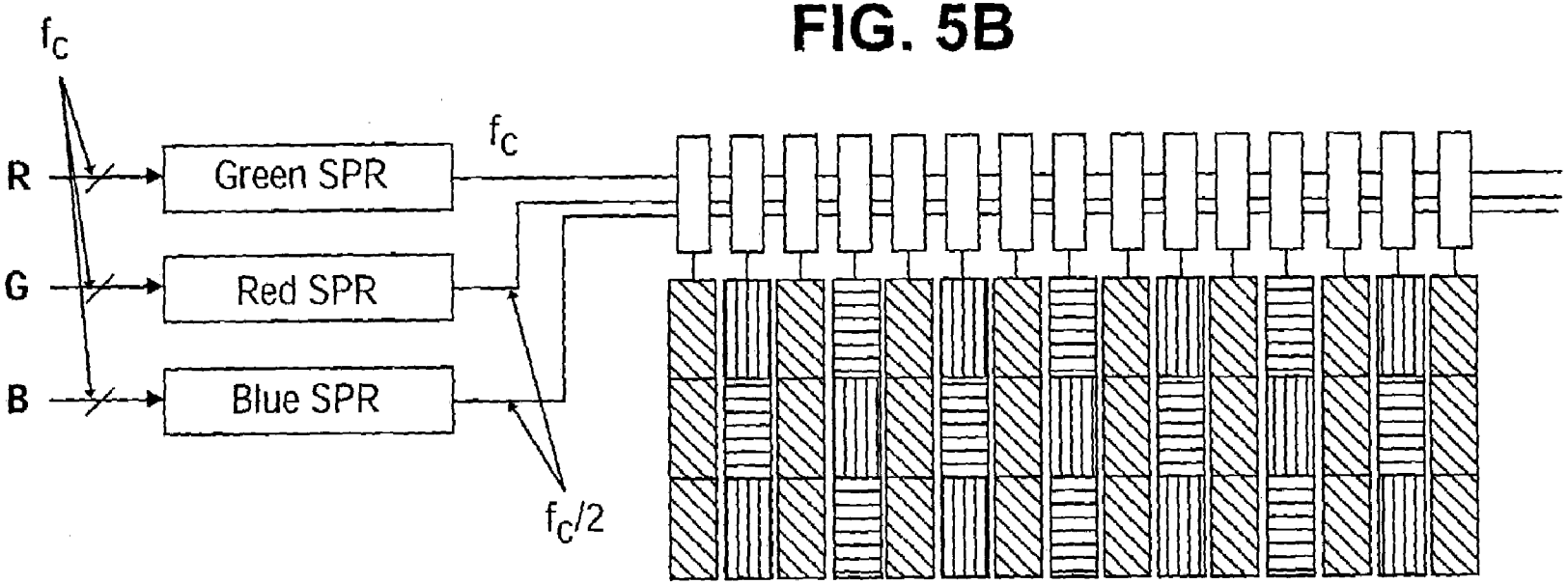
FIG. 5B is another embodiment of the integrated SPR circuitry onto a display panel where the panel comprising a subpixel layout with at least one column having alternating color data.

FIG. 5B shows an alternative data flow where data from the three separate SPR blocks are transmitted on three separate data paths. As shown, the incoming data frequency into the SPR circuitry is at a certain frequency ($f_C$). In one embodiment, the data frequency out of the green SPR could be clocked at the same frequency, $f_C$, while data frequency out of the red and blue SPR could be clocked at half that frequency, $f_C/2$.

Figure 5C:
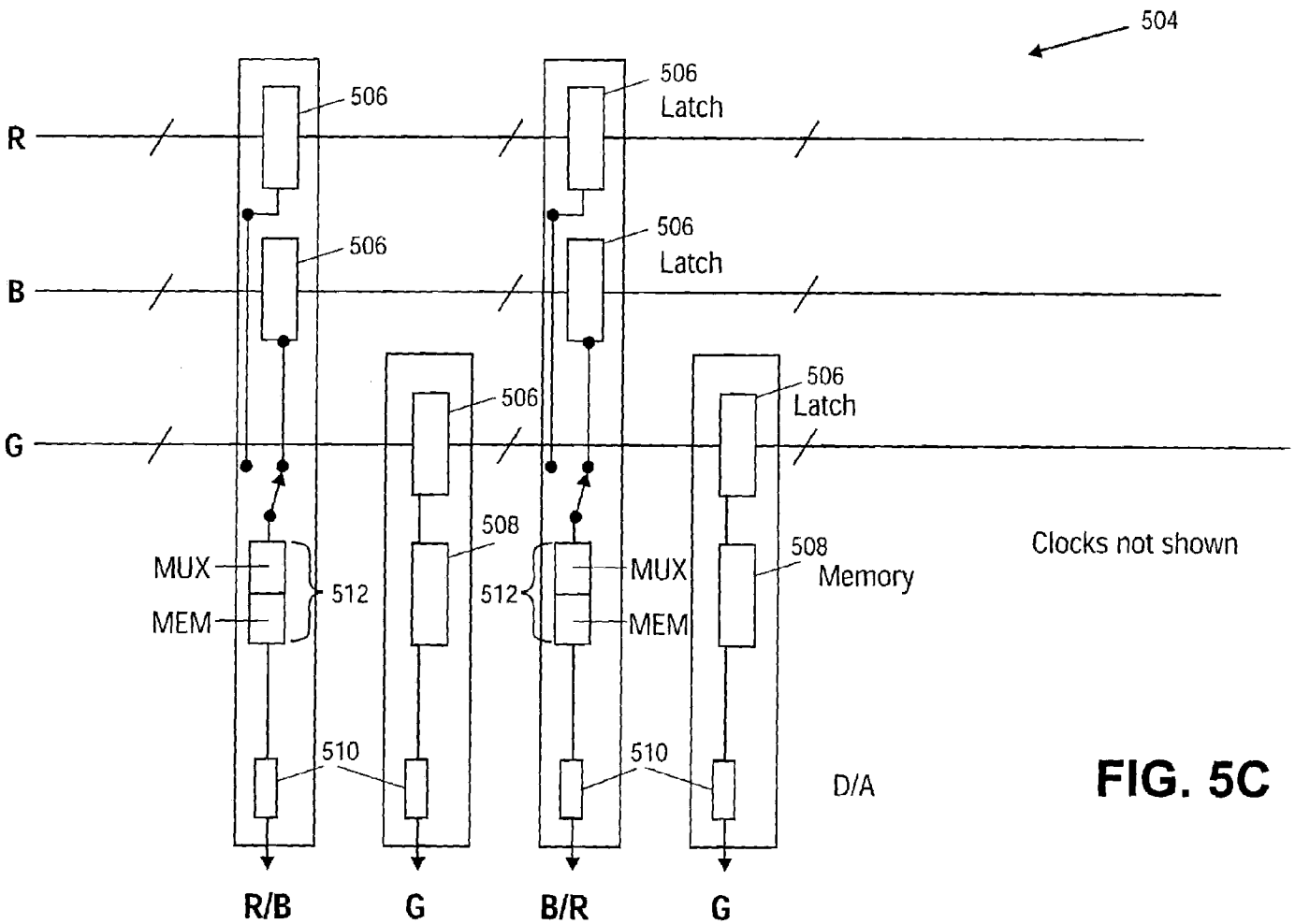
FIG. 5C is an embodiment of a driver circuit suitable to drive data lines in FIG. 5B.

FIG. 5C shows a suitable driver circuit which would service both the green and the red/blue columns. Driver 504 might comprise latch 506, memory 508 and D/A 510 elements. In all cases, the data from the SPR block is transmitted in digital or analog form to a latch (digital) or sample and hold circuit (analog) during one display line time. In the case of digital data, the number of parallel lines, indicated by the slash mark, is equal to the resolution of the panel. For example, a 6 bit panel (64 levels) will have 6 parallel lines. Before the next line of data is present (retrace time), the data is transferred to a second memory 508 (for green data). For red and blue data, this data is sent to a MUX/Memory component 512, that would select the appropriate red or blue data and store it into memory. MUX/Memory 512 could be implemented as one component or separately. During the next line time, the data is transferred to the column lines directly (for analog) or thorugh a digital to analog (D/A) converter. While the data is transferred to the column lines of the display, new data is read into the latches 506.

Figure 6A:
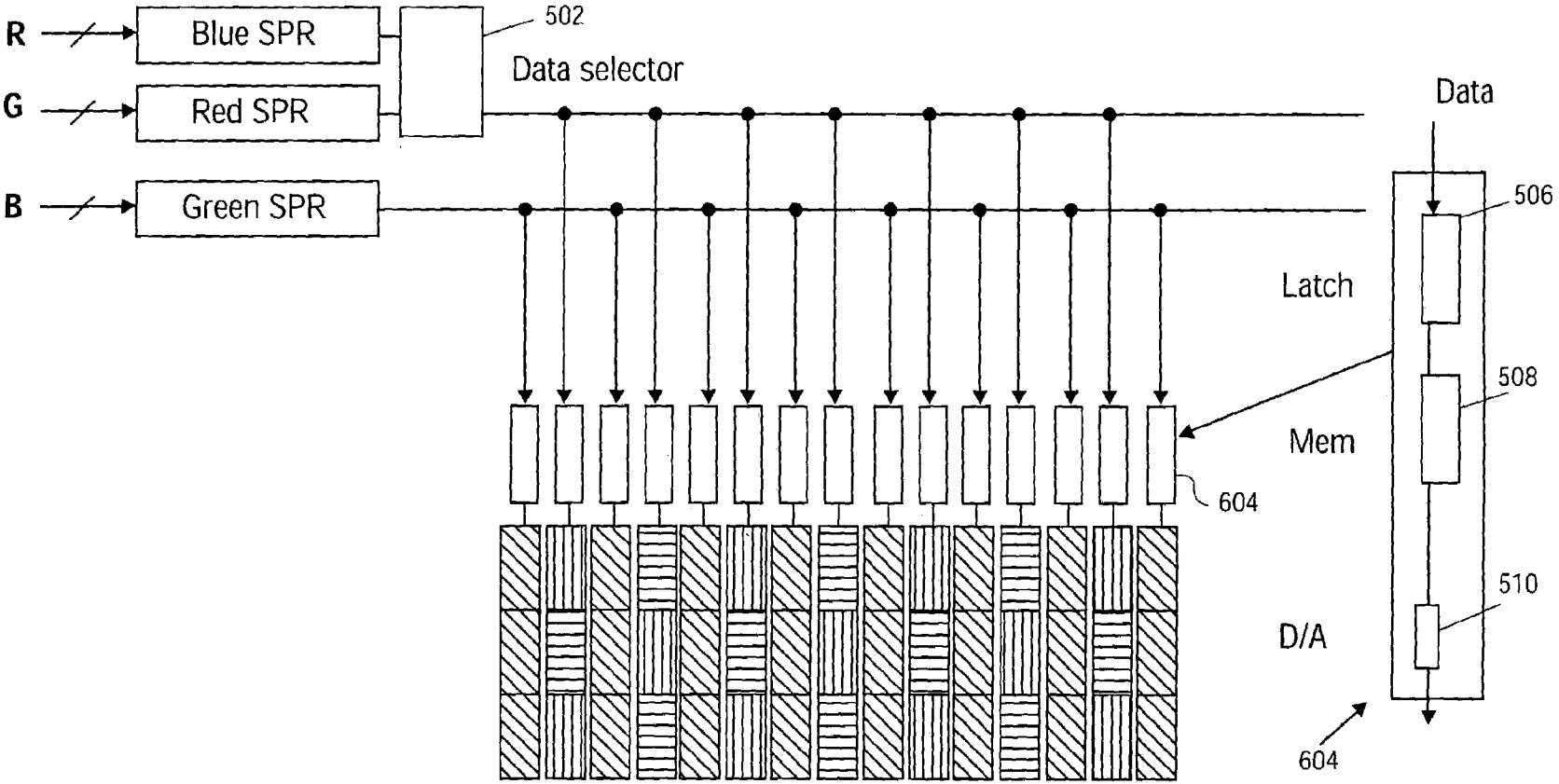
FIG. 6A is yet another embodiment of the integrated SPR circuitry onto a display panel where the panel comprising a subpixel layout with at least one column having alternating color data.
Figure 6B:
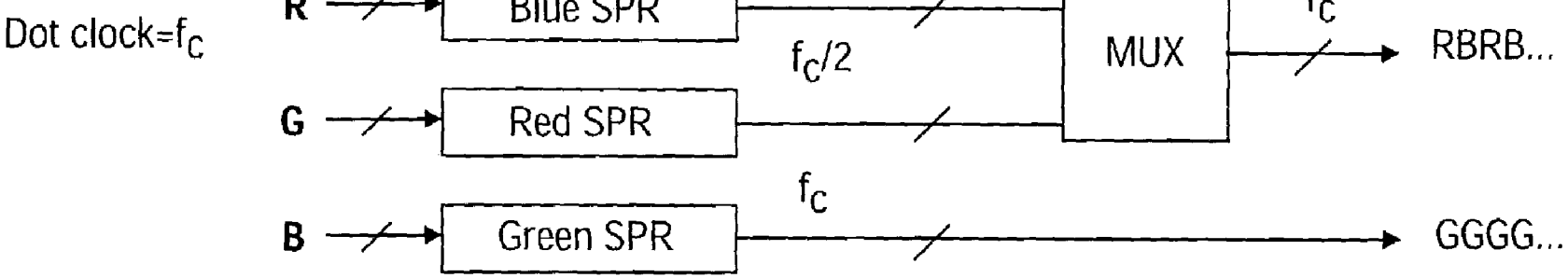
FIG. 6B is an embodiment of the integrated SPR circuitry showing the multiplexing of two data channels.

FIG. 6A is yet another embodiment of the integrated SPR circuitry onto a display panel. In this embodiment, data selector 502 inputs red and blue data from the respective SPR units and outputs the appropriate data for proper rendering to the panel. In this case, there would be no need for a different driver circuit 604 for green, red/blue subpixel columns. It will be appreciated that, like the SPR circuitry, data selector 502 could be constructed onto the panel itself, or reside off panel in a suitable chip. FIG. 6B shows the details of the data selector 502 implemented as a MUX circuit 602. The clock frequency of red/blue data is equal to green data after the MUX, but there are only two data paths to the column driver circuits.

Figure 7:
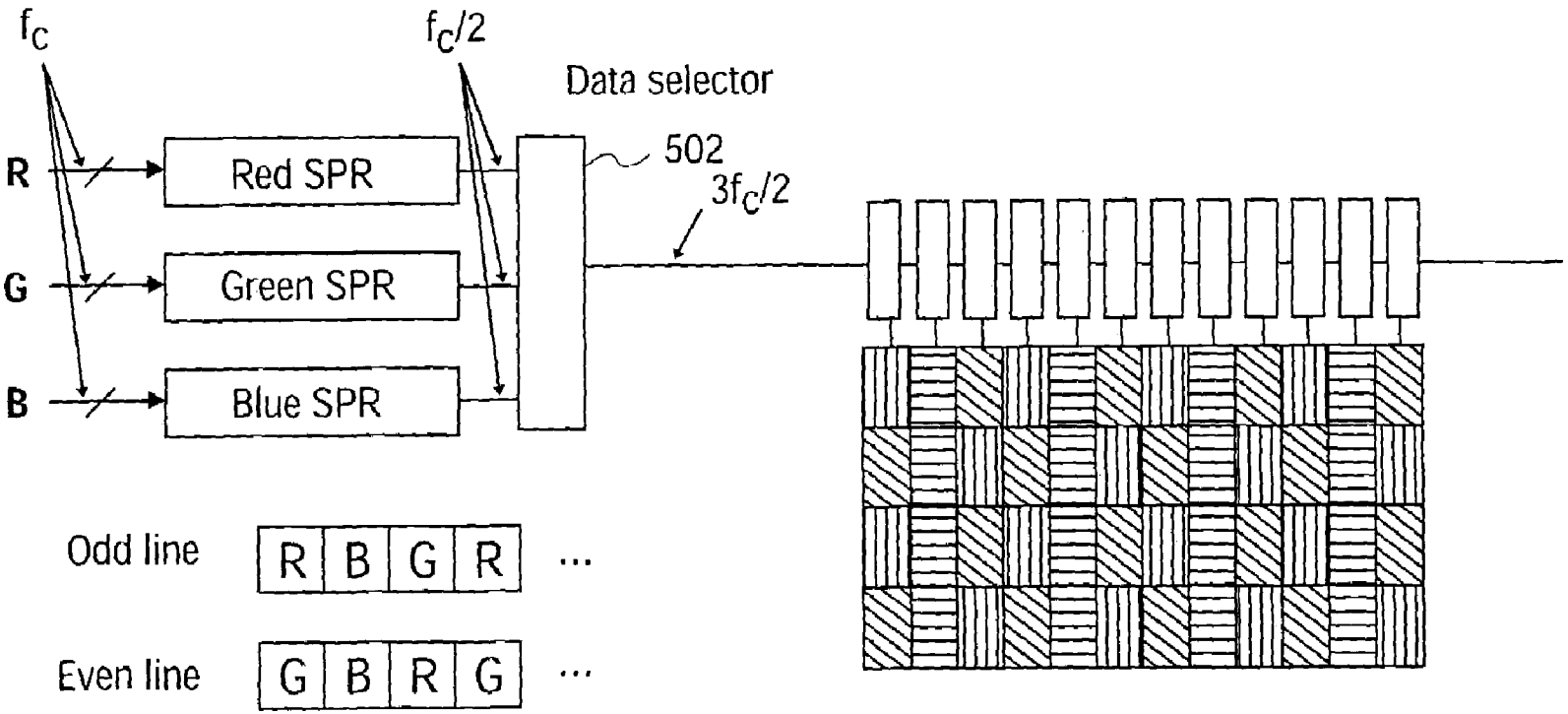
FIG. 7 is yet another embodiment of the integrated SPR circuitry onto a display panel where the panel comprising another subpixel layout with at least one column having alternating color data.

FIG. 7 is yet another embodiment of the integrated SPR circuitry onto a display panel. In this embodiment, the display panel 702 comprises another unique subpixel arrangement as described in the '232 application. In this case, blue data is passed down an entire column, while the red/green data alternate down a next column. Thus, the SPR circuitry for FIG. 7 might parallel the circuitry shown in FIG. 5A, except the roles of blue and green data are different. In one embodiment, the data clock, running at a frequency, $f_C$, is input into the R, G, and B SPR circuitry. The data that is output might run at $f_C/2$, which is then input into data selector 502. The output of data selector 502 might run at $3f_C/2$, which in turn is input into the driver circuits. Thus, while the number of data lines have been reduced from three lines down to one line, the data clock rate going to the panel is 50% higher than running into the SPR. This tradeoff might be important for smaller displays where the dot clock can be run slower.

Figure 8:
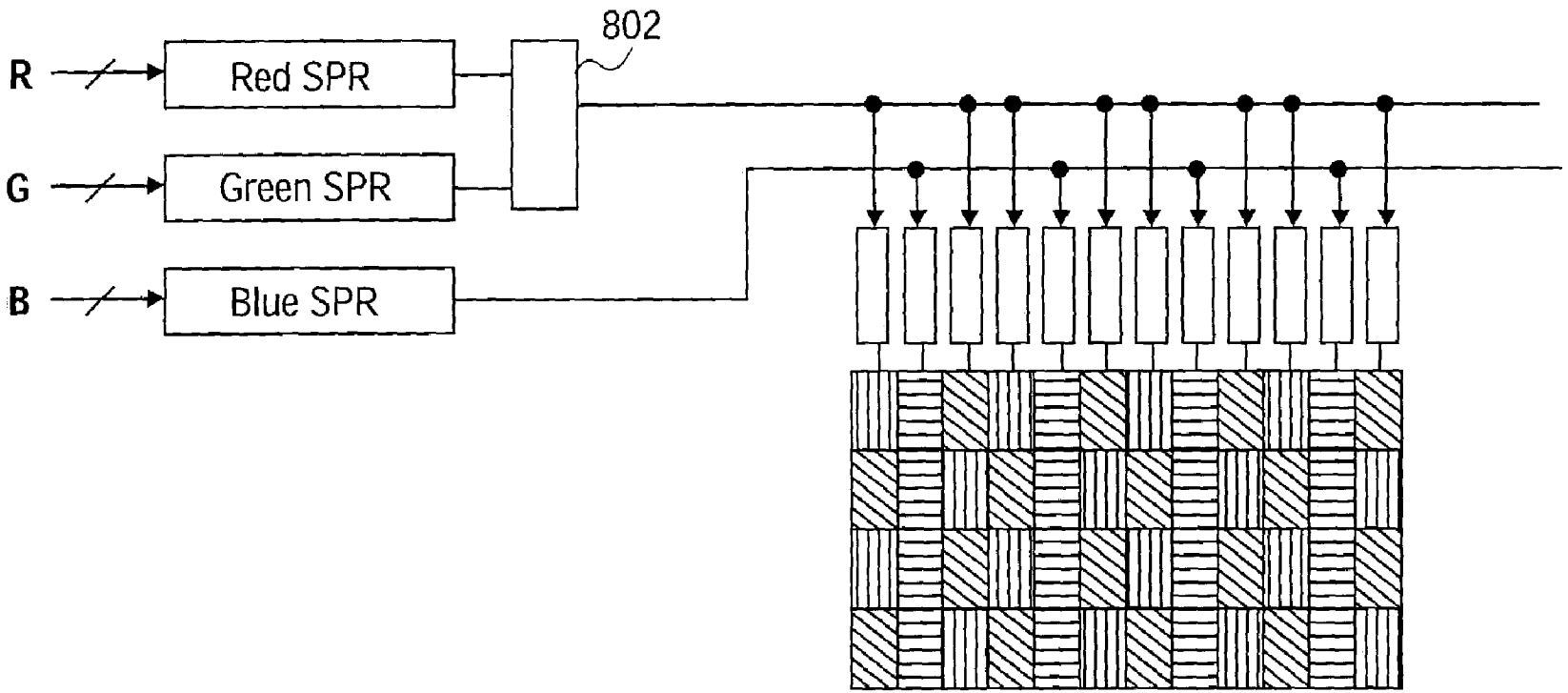
FIG. 8 is yet embodiment of the integrated SPR circuitry onto a display panel where the panel comprising the subpixel layout of FIG. 7.

Similarly, FIG. 8 would be the parallel of FIG. 6, except the roles of blue and green data are different. In this case, the number of data lines to the panel are two line, as opposed to three lines. Data selector 802 would switch red and green data appropriately according to the row being written. It should be appreciated that the principles of these embodiments apply to any display whereby at least one column alternates between two or more colors and that the scope of the present invention contemplates application of such principles.

Although the foregoing embodiments have been described as having particular advantage with certain parts of the driver and/or SPR processing circuitry as being implemented on the panel itself with its TFTs, the same circuitry and architecture could be implemented off the panel entirely. The advantage would still remain in reducing the number of data lines going into the panel itself with the application of the data selector circuit as described.

While the invention has been described with reference to exemplary embodiments, it will be understood that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A display system comprising:

a panel, said panel comprising a repeating subpixel grouping, each subpixel comprising one of a group, said group comprising a first color subpixel, a second color subpixel and a third color subpixel; said subpixel grouping comprising a plurality of columns wherein at least a first and a third column further comprising an alternating pattern of subpixels of said first color and subpixels of said second color;

said subpixel grouping further comprising a second column of subpixels of said third color and said first and said third column comprising a checkerboard pattern of said first and said second color subpixels;

a set of drivers coupled to said columns of subpixels;

a subpixel rendering circuit coupled to said drivers, said subpixel rendering circuit to output first color data, second color data, and third color data to said first color subpixels, said second color subpixels, and said third color subpixels respectively; and wherein said first color data, said second color data, and said third color data are output to said set of drivers with less than three data lines.

2. The display system as recited in claim 1 wherein said system further comprises:

a data selector to input said first color data and said second color data on a first input data line and a second input data line respectively; and wherein said data selector is to output a serial stream of first color data and second color data on a first output data line.

3. The display system as recited in claim 1 wherein said system further comprises:

a data selector to input said first color data, said second color data, and said third color data on a first input data line, a second input data line, and a third input data line respectively; and wherein said data selector is to output a serial stream of first color data, second color data, and third color data on a first output data line.

4. The display system as recited in claim 1 wherein said panel comprises a liquid crystal display panel and said drivers are constructed on said panel with said panel's thin film transistors.

5. The display system as recited in claim 1 wherein said panel comprises a liquid crystal display panel and drivers an said subpixel rendering circuit are constructed on said panel with said panel's thin film transistors.

6. A display system comprising:

a panel, said panel comprising a plurality of a repeating subpixel grouping, each subpixel comprising one of a group, said group comprising at least a first color subpixel, a second color subpixel and a third color subpixel; said subpixel grouping comprising a plurality of columns wherein a first and a third column further comprising subpixels of said first color and subpixels of said second color;

said subpixel grouping further comprising a second column comprising subpixels of said third color and said first and said third columns further comprising a checkerboard pattern of said first and said second color subpixels;

a set of drivers coupled to said columns of subpixels;

a subpixel rendering circuit coupled to said drivers, said subpixel rendering circuit to output first color data, second color data, and third color data to said first color subpixels, said second color subpixels, and said third color subpixels respectively; and wherein said first color data, said second color data, and said third color data are output to said set of drivers with less data lines than data lines input into said subpixel rendering circuit.

* * * * *